US008459071B2

(12) United States Patent
Andersson

(10) Patent No.: US 8,459,071 B2
(45) Date of Patent: Jun. 11, 2013

(54) LOCK DEVICE

(75) Inventor: Daniel Andersson, Eskilstuna (SE)

(73) Assignee: Assa Abloy AB, Stockholm (SE)

( * ) Notice: Subject to any disclaimer, the term of this patent is extended or adjusted under 35 U.S.C. 154(b) by 652 days.

(21) Appl. No.: 12/596,870

(22) PCT Filed: Apr. 25, 2008

(86) PCT No.: PCT/SE2008/000291

§ 371 (c)(1),
(2), (4) Date: Oct. 21, 2009

(87) PCT Pub. No.: WO2008/133574

PCT Pub. Date: Nov. 6, 2008

(65) Prior Publication Data

US 2010/0139341 A1 Jun. 10, 2010

(30) Foreign Application Priority Data

Apr. 27, 2007 (SE) ..... 0701025

(51) Int. Cl.
*E05B 13/10* (2006.01)

(52) U.S. Cl.
USPC ..... 70/210; 70/163; 70/278.1; 70/283

(58) Field of Classification Search
USPC ..... 70/63, 158, 163, 164, 166–173, 209, 70/210, 277, 278.1, 278.7, 280, 281, 282, 70/283
See application file for complete search history.

(56) References Cited

U.S. PATENT DOCUMENTS

| | | | | |
|---|---|---|---|---|
| 4,761,976 | A * | 8/1988 | Kleinhany | 70/277 |
| 4,771,620 | A * | 9/1988 | Kleinhany | 70/277 |
| 5,542,274 | A * | 8/1996 | Thordmark et al. | 70/495 |
| 6,158,259 | A * | 12/2000 | Schmitz et al. | 70/276 |
| 6,264,256 | B1 * | 7/2001 | Hankel et al. | 70/278.1 |
| 6,418,764 | B1 * | 7/2002 | Lerchner | 70/279.1 |
| 6,460,903 | B1 * | 10/2002 | Ming-Chih | 292/172 |
| 6,865,916 | B2 * | 3/2005 | Goldman | 70/472 |
| 6,892,557 | B2 * | 5/2005 | Bieniek | 70/278.7 |
| 7,000,441 | B2 * | 2/2006 | Sutton et al. | 70/276 |
| 7,591,160 | B2 * | 9/2009 | Keller | 70/277 |
| 7,966,854 | B2 * | 6/2011 | Imedio Ocana | 70/472 |
| 2004/0040352 | A1 | 3/2004 | Yu et al. | |
| 2004/0250578 | A1 * | 12/2004 | Sakai | 70/277 |
| 2004/0255628 | A1 | 12/2004 | Meyerle | |

FOREIGN PATENT DOCUMENTS

| | | |
|---|---|---|
| WO | WO 0017475 | 3/2000 |

OTHER PUBLICATIONS

International Search Report and Written Opinion for PCT/SE08/000291 mailed Jul. 1, 2008.

* cited by examiner

*Primary Examiner* — Christopher Boswell
(74) *Attorney, Agent, or Firm* — Holland & Hart LLP

(57) ABSTRACT

A lock device comprises an interlocking means comprising two axially movable parts (61, 62) interconnecting a cylinder core (20) and an extension (40, 50) so that free-turning operation is provided in one mode of operation and the extension rotates with the cylinder core in another operational mode.

18 Claims, 7 Drawing Sheets

LOCK DEVICE

FIELD OF INVENTION

The present invention relates generally to lock devices and more particularly to a modular lock cylinder having a free-turning function between the cylinder core and the tailpiece.

BACKGROUND

Lock cylinders are arranged to transfer a rotational movement from a cylinder core to a tailpiece provided to actuate a lock mechanism in for example a lock case. The cylinder core can be turned by means of e.g. a key or a knob. In many lock cylinders, a blocking mechanism is provided to allow only an authorized user to operate the lock cylinder. This blocking mechanism prevents turning of the cylinder core for example in the case an incorrect key is inserted in the lock cylinder.

As an alternative to a blocking mechanism preventing turning of the cylinder core, an arrangement can be provided which decouples or disconnects the cylinder core from the tailpiece. In this case, when an incorrect key is inserted in the lock cylinder, the cylinder core can be freely rotated without causing rotation of the tailpiece. This prevents the lock device from being readily wrenched or pried apart.

The lock industry is faced with demands on cost reductions and one way of meeting this demand is to use the same kind of components in different lock configurations. This however requires modularity in the design of the different parts making up the lock devices. This is particularly true in electronic or electro-mechanical lock devices, wherein the cost for the electronic components is drastically reduced with large-scale production.

SUMMARY OF THE INVENTION

An object of the present invention is to provide a lock device of the kind initially mentioned which has a simple and yet reliable design of an interlocking mechanism arranged to permit and prevent free-turning rotation between two parts of a lock device.

The invention is based on the realization that an interconnection means between a cylinder core and a tailpiece can be provided in two axially movable parts.

Thus there is provided a lock device, wherein the forces on the interconnection means are not transferred to the actuator controlling the operation mode. This actuator can thereby be dimensioned for small forces, decreasing the size and cost of the lock device.

In a preferred embodiment, the extension is provided with at least one flange arranged to cooperate with the interlocking means so as to achieve secure interlocking between the extension and the cylinder core.

In yet a preferred embodiment, the first part of the interlocking means exhibits a beveled end surface facing the extension to provide smooth operation of the lock device.

It is further preferred that the blocking means comprises a shoulder on an actuator and the second part comprises a pin arranged on cooperate with the shoulder on the actuator, wherein the shoulder is arranged to selectively prevent movement of the second part from its outer end position to its inner end position. In this way, the load on the first part is not transferred to the actuator.

BRIEF DESCRIPTION OF DRAWINGS

The invention is now described, by way of example, with reference to the accompanying drawings, in which.

DETAILED DESCRIPTION OF THE INVENTION

Figure 1:
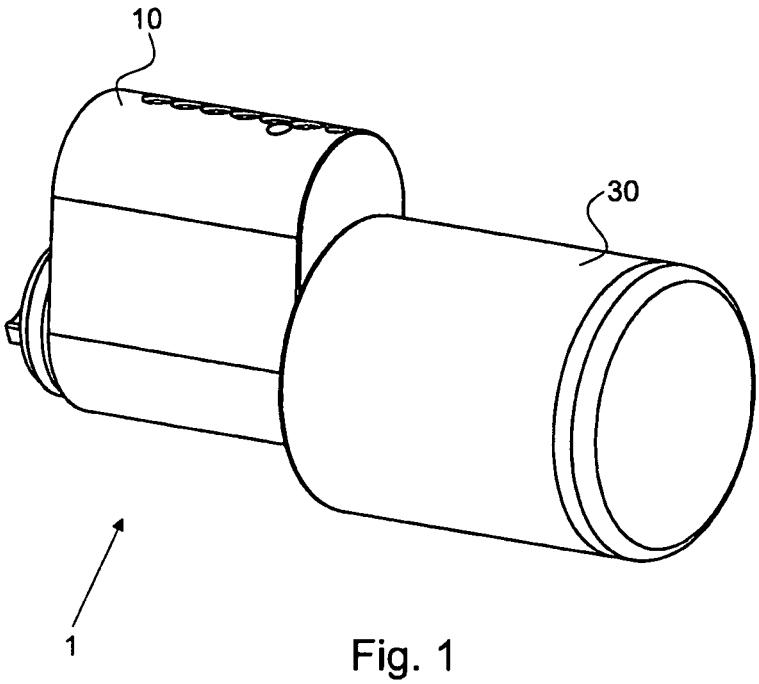
FIG. 1 is an overall view of a lock device according to the invention.
Figure 2:
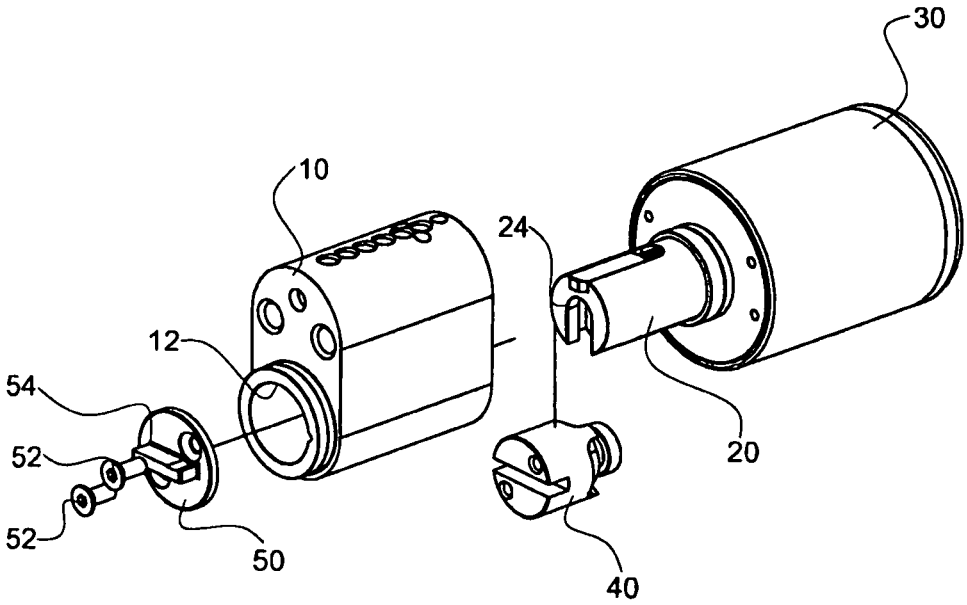
FIGS. 2 and 3 are exploded perspective views of the lock device of FIG. 1.
Figure 3:
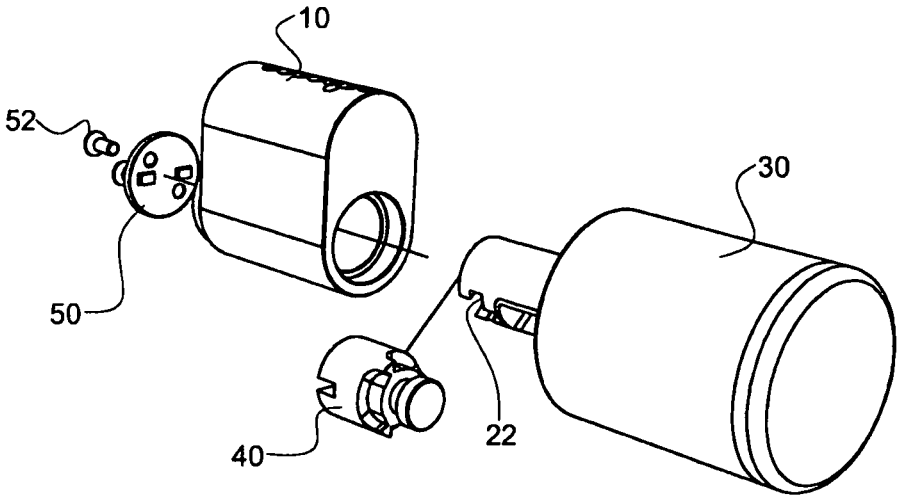

In the following a detailed description of a preferred embodiment of the present invention will be given. In this description, references will be made to directions, such as upper and lower. It will be realized that these references are non-limiting and only refer to the directions shown in the figures.

A lock device, generally designated 1, comprises a cylinder housing 10 having a circular cavity or bore 12 extending axially through the full length of the cylinder housing. A cylindrical cylinder core 20 having a longitudinal axis is arranged rotatably in the cavity as will be explained below. A knob 30 is fixedly attached to the outer end portion of the cylinder core 20 and comprises electronic authorization means, such as a microprocessor, control electronics, antenna etc. (not shown).

An adapter 40 is arranged for insertion into the cavity 12 in the cylinder housing 10. Thus, the adapter has an overall cylindrical shape allowing rotation in the cylinder housing cavity. A circumferential groove 42 is provided on the adapter near a first end portion 44 thereof facing the cylinder core 20. This groove and the end portion of the adapter are arranged to cooperate with a recess 22 in the end portion 24 of the cylinder core 20 facing the adapter 40. In other words, the end portions of the adapter and the cylinder core interact in an axial direction in a dovetail like fashion.

Figure 4:
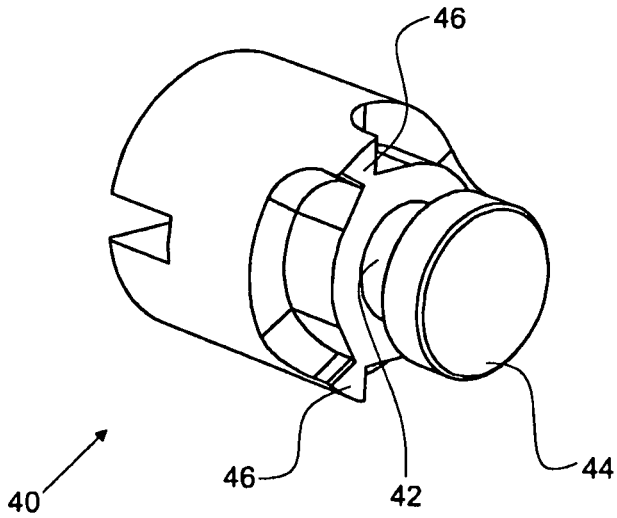
FIG. 4 is an enlarged view of an adapter comprised in the lock device.
Figure 5:
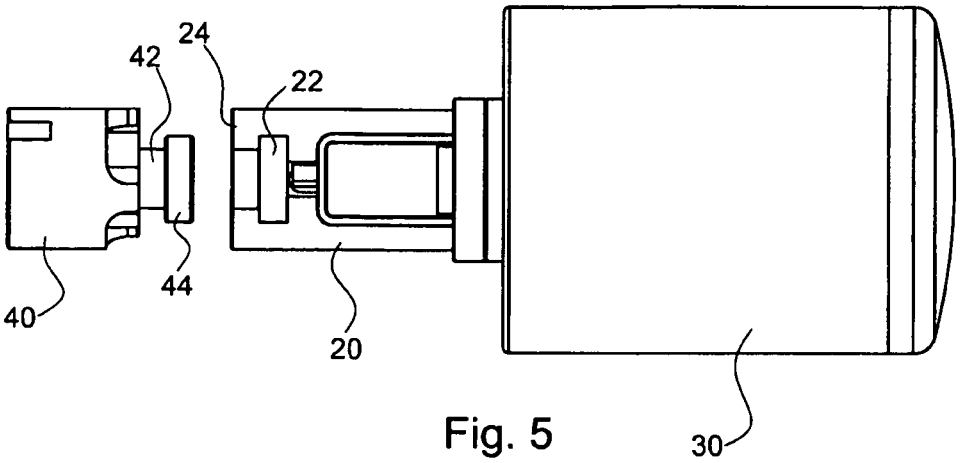
FIGS. 5 and 6 are plan views showing the adapter of FIG. 4 and a cylinder core disconnected and interconnected, respectively.
Figure 6:
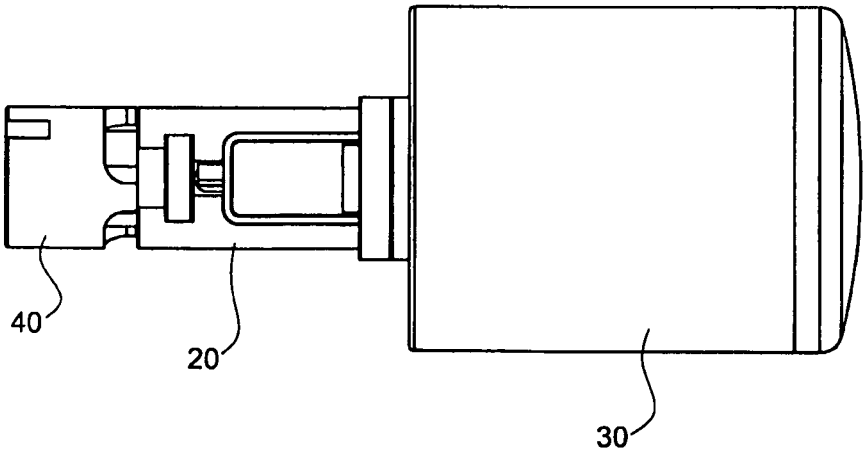
Figure 7:
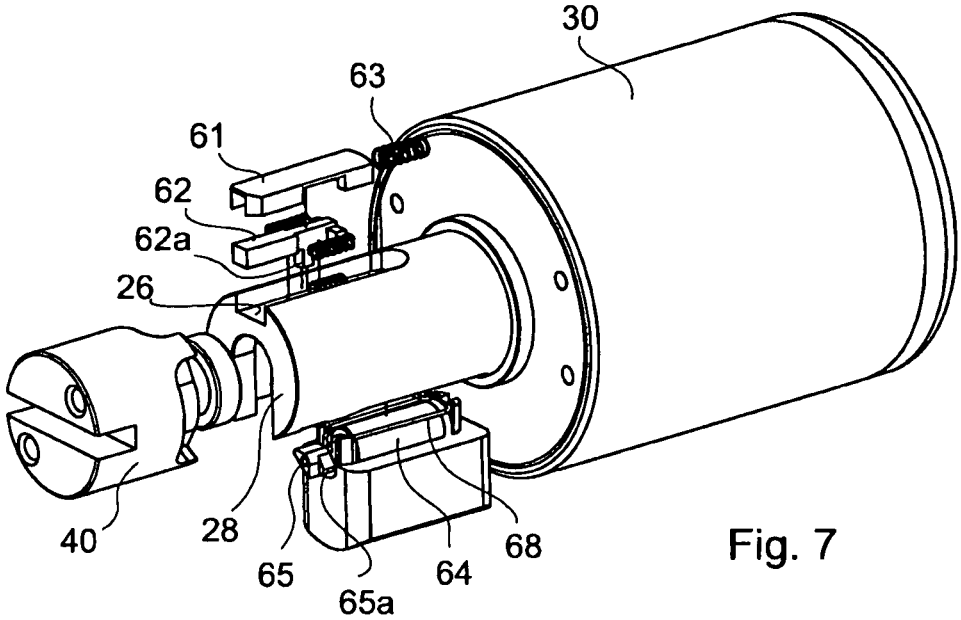
FIG. 7 is an exploded perspective view showing the different parts of an interlocking mechanism comprised in the lock device of FIGS. 1-3.

The adapter 40 is provided with one or more flanges 46 and preferably three equally spaced flanges, see FIG. 4. These flanges are arranged to cooperate with movable interlocking means in the cylinder core 20.

In axially extended position of the interlocking means, i.e., when the interlocking means extend so that it overlaps the flanges 46 in an axial direction, mutual free-turning rotation between adapter and cylinder core is blocked. In axially retracted position of the interlocking means, mutual free-turning rotation between adapter and cylinder core is allowed.

The engagement between the end portions of the adapter and the cylinder core prevents mutual axial movement between the adapter and the cylinder core while allowing mutual rotational movement there between in a free-turning operational mode. Thus, during assembly of the lock device, the end portion 44 of the adapter is inserted into the recess 22 of the cylinder core before inserting the adapter 40 into the cavity 12 of the cylinder housing 10. In this way, the adapter and the cylinder core make up one single unit before insertion into the cylinder housing.

A tailpiece 50 is attached to the end surface of the adapter opposite to the first end portion thereof by means of two screws 52. This tailpiece has a diameter, which is larger, and preferably slightly larger than the diameter of the cavity 12 in the cylinder housing 10. This means that when the adapter 40 and the cylinder core 20 are interconnected and the tailpiece 50 is attached to the adapter, the arrangement comprising these parts is fixed against axial movement in the cylinder housing 10.

An integrated coupling 54 is arranged on the end surface of the tailpiece 50, being arranged to cooperate with a lock mechanism provided in a lock case, for example. The combination of the adapter 40 and the tailpiece 50 thus constitutes an extension acting as a bridge between the cylinder core and the lock mechanism.

The provision of an adapter between the cylinder core and the tailpiece makes possible the use of a single type of cylinder core in many types of cylinder housings and together with different types of tailpieces. This in turn reduces the total production costs since the cost for the adapter itself is relatively low.

The operation of the lock device 1 will now be explained. In a first mode of operation, the interlocking means provided in the cylinder core 20 is retracted, resulting in free-turning operation. This means that when the knob 30 is turned, the cylinder core 20 turns therewith but the adapter and tailpiece do not, resulting in a locked state of the lock device. If the interlocking means is moved to an extended position, such as by means of an electronic arrangement controlled by means of a remote control, the adapter and tailpiece turn with the knob, resulting in an unlocked state of the lock device.

The operation of the interlocking mechanism between the cylinder core 20 and the adapter 40 will now be described in detail with reference to FIGS. 5-17. This interlocking mechanism comprises two parts, namely an outer slide 61 and an inner slide 62, which are provided axially movable in a longitudinal groove 26 in the cylinder core 20 between a respective outer end position, wherein the slide extends from the inner end surface of the cylinder core facing the adapter 40 and the tailpiece 50, and an inner end position, wherein it is retracted from the inner end surface 28 of the cylinder core. The outer slide 61 is biased in the direction of the adapter 40 by means of a spring 63 and is beveled at the end surface 61*a* facing the adapter. This beveling results in that if the outer slide protrudes from the inner end surface 28 of the cylinder core, the flanges 46 of the adapter will push the outer slide against the force of spring 63 when the cylinder core 20 is rotated relatively to the adapter 40, as will be explained below. The inner slide 62 is provided with a downwardly extending pin 62*a*, which is arranged to function as part of a blocking means, see below.

An electrical motor 64 is provided with a rotational actuator 65 arranged on the shaft of the motor. This actuator is provided with a shoulder 65*a*, which is arranged to interact with the pin 62*a* of the inner slide 62, thereby constituting part of the above mentioned blocking means. The operation of the motor 64 is controlled by means of the electronic authorization means provided in the knob 30.

In order to prevent unauthorized manipulation of the lock device by so-called knocking, wherein the position of the actuator 65 is adjusted by causing vibrations, a damping spring 68 is arranged for damping rotation of the actuator 65. This function is similar to the damping spring disclosed in the international publication WO2006/118519, assigned to ASSA AB.

The outer and inner slides 61 and 62, respectively, cooperate in the following way, see FIGS. 8*a* and 8*b*, which show the slides from below, i.e., from the inner of the cylinder core 20. The inner slide 62 is arranged in a groove in the bottom surface of the outer slide 61 and is thus guided to an axial movement. The inner slide 62 is spring biased to the position shown in FIG. 8*a* relatively to the outer slide 61 by means of two resilient means, in the shown embodiment springs 66. In other words, in a resting position of the inner slide 62 the outer end portion thereof will not protrude from the outer end surface of the outer slide 61.

Figure 8A:
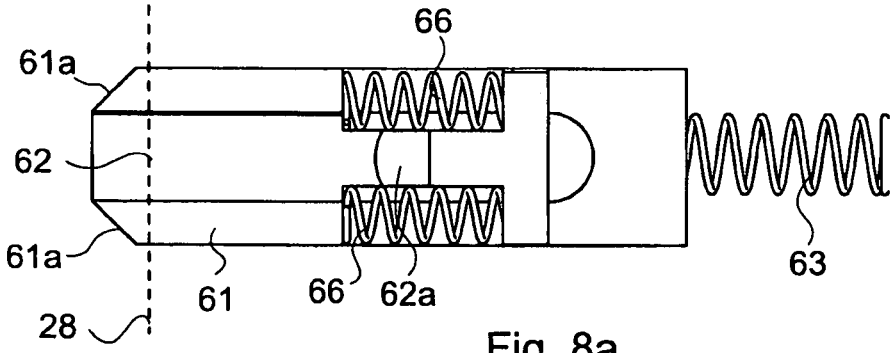
FIGS. 8*a* and 8*b* show in a plan view from below the interlocking mechanism in free-turning and interlocked operation of the lock device, respectively.

It is realized that if the inner slide 62 is retained against movement, e.g. by means of the cooperation between the inner slide pin 62*a* and the actuator shoulder 65*a*, the outer slide 61 is still free to move to the right from the position shown in FIG. 8*a*. During this movement, the springs 66 will be compressed, as shown in FIG. 8*b* and the outer end portion of the inner slide 62 will protrude from the outer end portion of the outer slide 61.

Figure 9A:
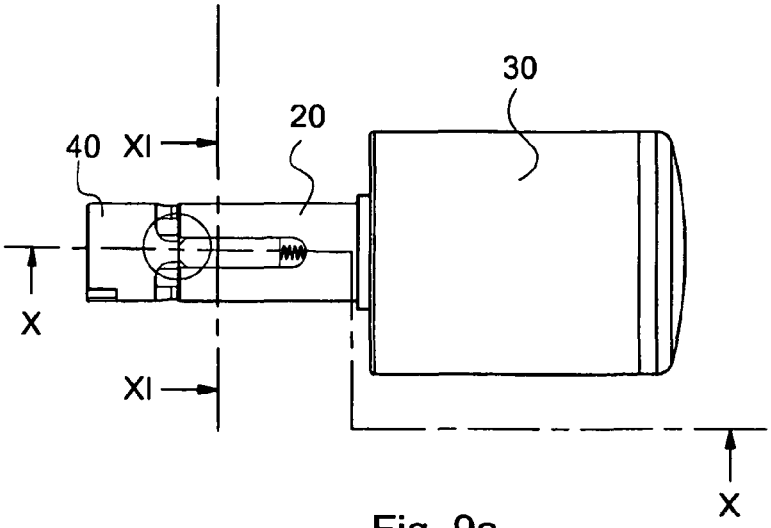
FIG. 9*a* is a plan view of the lock device of FIGS. 1-3 during free-turning operation.
Figure 9B:
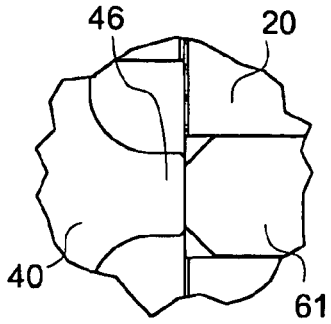
FIG. 9*b* is an enlarged view of the interlocking mechanism shown in FIG. 9*a;*
Figure 10A:
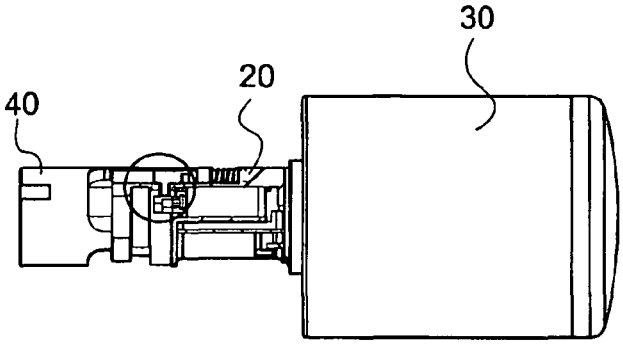
FIG. 10*a* is a sectional view taken along line X-X of FIG. 9*a;*
Figure 10B:
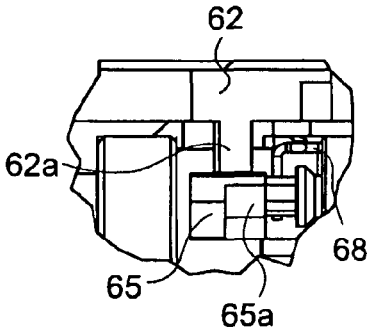
FIG. 10*b* is an enlarged view of the interlocking mechanism shown in FIG. 10*a;*

Free-rotating operation, i.e., locked position of the lock device 1, will now be explained primarily with reference to FIGS. 9*a,b*-14*a,b*. FIG. 9*a* shows a top view of the lock device 1 while FIG. 9*b* shows an enlarged view of the encircled portion of the lock device in FIG. 9*b*. The outer slide 61 provided in the longitudinal groove 26 of the cylinder core 20 is aligned with one of the flanges 46 on the end portion of the adapter 40. By means of this flange 46, the outer slide is kept in an inner end position wherein the spring 63 is compressed.

Figure 11A:
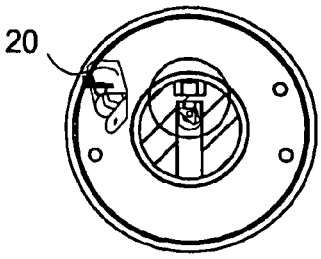
FIG. 11*a* is a cross-sectional view taken along line XI-XI of FIG. 9*a;*
Figure 11B:
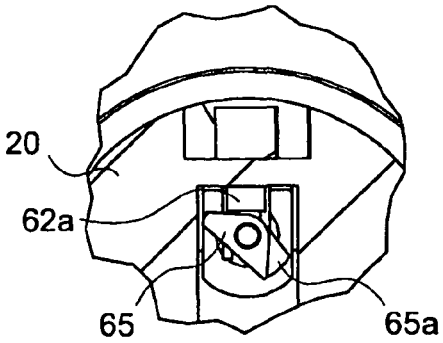
FIG. 11*b* is an enlarged view of the interlocking mechanism shown in FIG. 11*a;*

Since the actuator 65 is in a rotational position wherein the shoulder 65*a* does not block the movement of the tap 62*a* of the inner slide 62, see FIG. 11*b*, this inner slide moves with the outer slide, as has been explained above with reference to FIGS. 8*a* and 8*b*.

When the knob 30 is rotated and the cylinder core 20 therewith, the outer and inner slides 61, 62 are moved out of alignment with the flange 46. This means that the slides are allowed to move to an extended position shown in FIG. 12*b*, corresponding to FIG. 8*a*, wherein the outer end portion of the slides extends from the inner end surface 28 of cylinder core 20. This movement is effected by means of the force exerted by the spring 63.

Figure 12A:
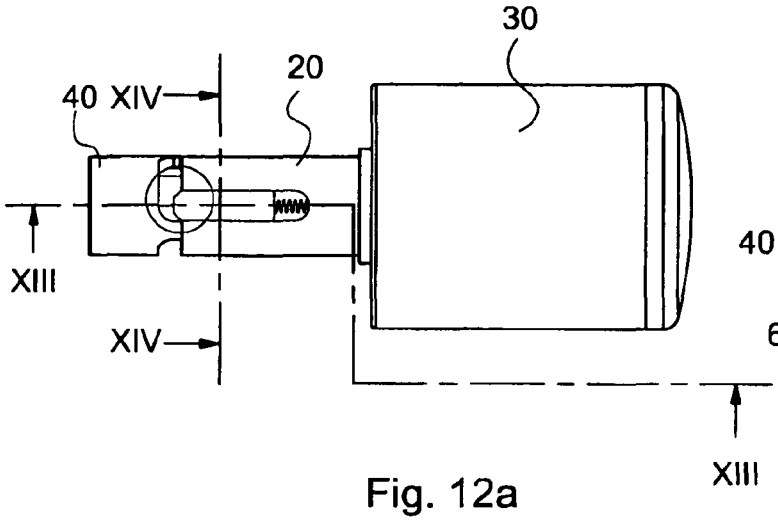
FIGS. 12*a,b*-14*a,b* correspond to FIGS. 9*a,b*-11*a,b* but with the cylinder core and the adapter in a different mutual angular position.
Figure 12B:
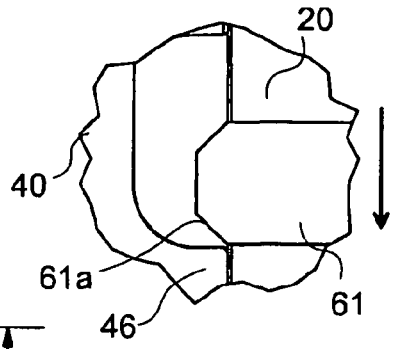

If the cylinder core 20 is rotated from the position shown in FIG. 12*b*, the outer end portion of the outer slide will eventually contact another one of the adapter flanges 46. The outer slide 61 and the inner slide 62 therewith will then be pushed to the inner end position shown in FIGS. 9*a* and 9*b* due to the beveled end surface 61*a* of the outer slide 61. This movement is conducted against the force of the spring 63 only since the inner slide 62 moves with the outer slide 61.

Since the slides 61, 62 are pushed from their outer end positions and to their inner end positions against the force of only spring 63 every time they encounter a flange 46 during rotation, a user will essentially experience free-rotation between the cylinder core 20 and the adapter 40 when the knob 30 is turned. The adapter 40 will therefore remain essentially stationary when the knob 30 is turned, thereby providing locked operation of the lock device 1.

Figure 15A:
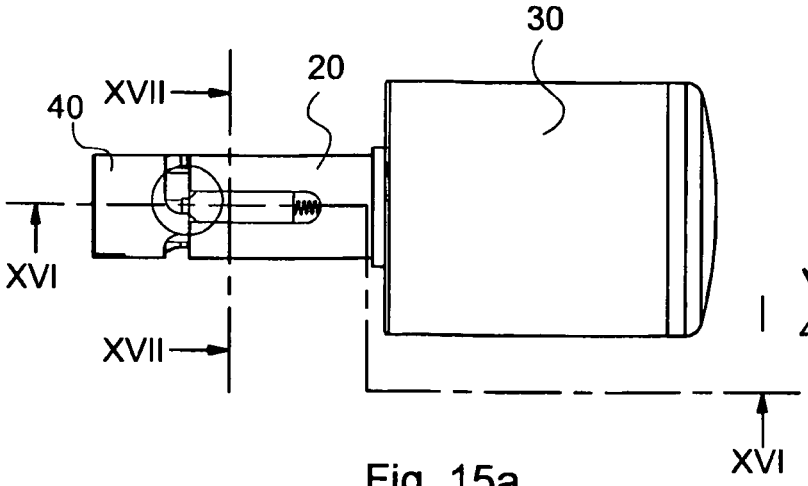
FIGS. 15*a,b*-17*a,b* correspond to FIGS. 9*a,b*-11*a,b* but during unlocked operation of the lock device.
Figure 15B:
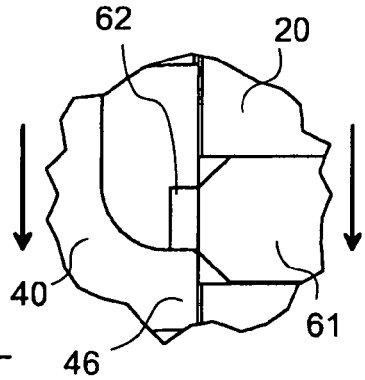
Figure 16A:
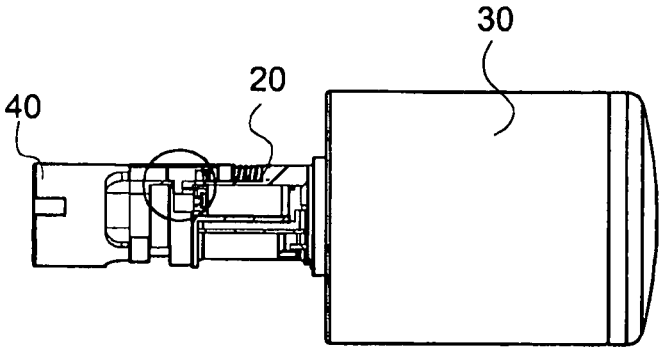
Figure 16B:
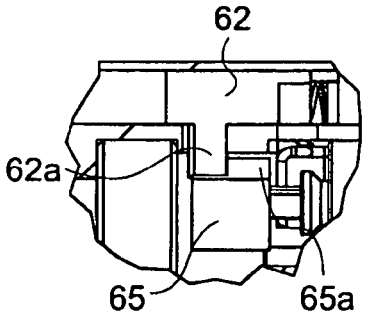

Turning now to FIGS. 15*a,b*-17*a,b*, unlocked operation of the lock device 1 will be described. One basic difference between the previously described locked operation and unlocked operation is that the actuator 65 has a rotational position during unlocked operation wherein the shoulder 65*a* thereof is aligned with the pin 62*a* of the inner slide 62 so that movement of the inner slide from its outer end position shown in e.g. FIGS. 12*a,b* and 15*a,b* is prevented. It is shown in FIG. 16*b* that the shoulder 65*a* is positioned "behind" the pin 62*a*, i.e., as seen from the adapter 40, thereby preventing or blocking the above-mentioned movement from the outer end position.

It should be noted that the movement of the outer slide 61 is in no way prevented by the actuator. This means that when the outer slide 61 encounters one of the flanges 46 during rotation of the knob 30 and the cylinder core 20, this outer slide will be pushed to its inner end position like in the locked or free-rotating operation, which has been described above with reference to FIGS. 9*a,b*-14*a,b*, this time against the combined force of the outer slide spring 63 and the inner slide springs 66.

Figure 8B:
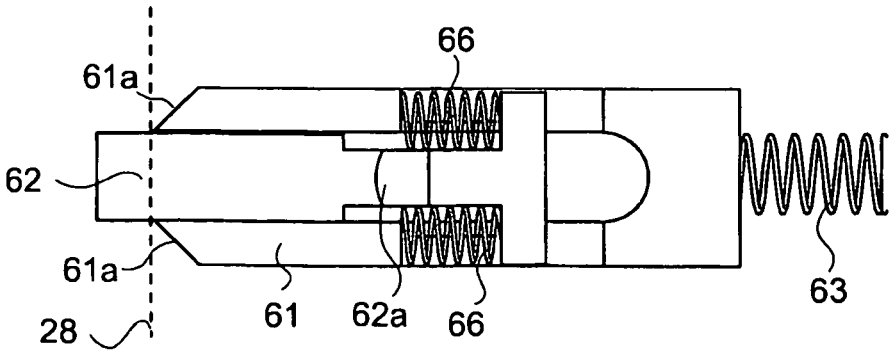

Since the inner slide 62 will remain in its outer end position, see FIGS. 15*a,b*, corresponding to FIG. 8*b*, this inner slide will block further mutual rotation between the cylinder core 20 and the adapter 40 when the flange 46 of the adapter abuts the inner slide 62, since the inner slide exposes an abutment surface to the flange, which is essentially perpendicular to the direction of rotation. Further rotation of the cylinder core 20 in the direction of the arrow of FIG. 15*b* will bring a corresponding rotation of the adapter 40 due to the interaction between the inner slide 62 of the cylinder core and the flange 46 of the adapter. This will in turn bring the above-mentioned lock mechanism, which is connected to the adapter 40 via the tailpiece 50, to an unlocked operating position.

It will be realized that the only force that is applied to the shoulder 65*a* of the adapter 65 is the spring force of the inner slide springs 66. Since these inner slide springs 66 can be made relatively weak—their only function is to ensure that the inner slide 62 moves with the outer slide 61 when the outer slide is moved from its outer end position—the forces exerted on the actuator 65 is relatively small, which is an advantage because the actuator can be dimensioned accordingly.

Figure 13A:
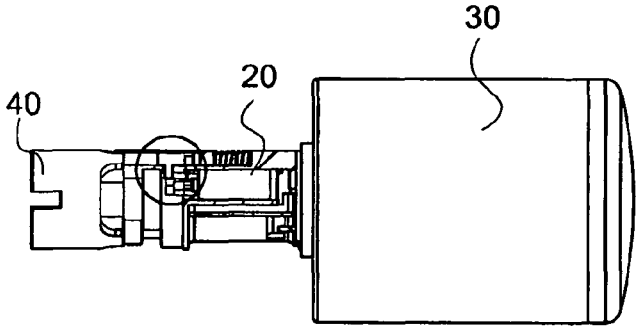
Figure 13B:
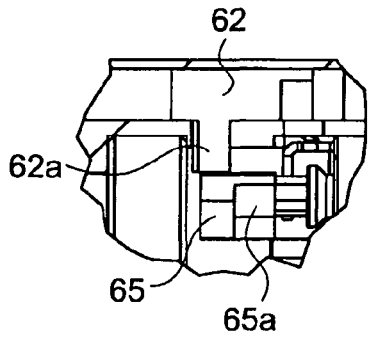
Figure 14A:
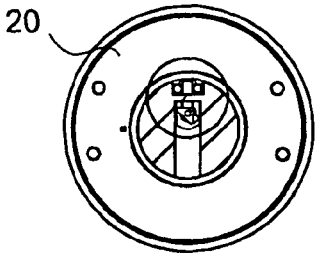
Figure 14B:
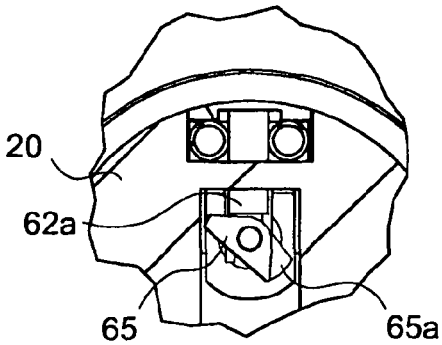
Figure 17A:
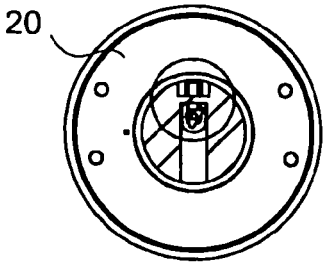
Figure 17B:
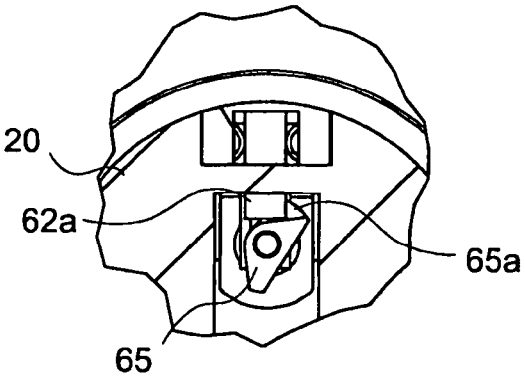

When the actuator 65 is moved from the position shown in FIGS. 16*b* and 17*b* to that of FIGS. 13*b* and 14*b*, the inner slide springs 66 will bring the inner slide 62 to a position relatively to the outer slide 61, wherein the outer ends thereof are flush with each other. In other words, moving the actuator so that the shoulder 65*a* and the pin 62*a* no longer are in engagement with each other will return the lock device 1 to free-rotation operation.

A preferred embodiment of a lock device according to the invention has been described. A person skilled in the art realizes that this could be varied within the scope of the appended claims. Thus, a knob-operated lock device has been shown and described. It will be realized that the inventive idea is applicable also for other kinds of lock cylinders, such as key operated ones.

The slide arrangement provided in the described lock can act directly on a lock mechanism without any intervening adapter. Thus, the inventive idea covers any embodiment wherein the interlocking means acts between a cylinder core or a similar arrangement, which is rotatable by means of a handle or the like, and a tailpiece acting on a lock mechanism.

The invention claimed is:

1. A lock device comprising:

a cylinder housing;

a substantially cylindrical cylinder core having a longitudinal axis and which is rotatably accommodated in the cylinder housing; and an extension arranged to cooperate with a lock mechanism;

wherein the substantially cylindrical cylinder core has an inner end surface facing the extension;

characterized by an interlocking means comprising:

a first part, which is movable axially between an outer end position, wherein it extends from the inner end surface of the substantially cylindrical cylinder core, and an inner end position, wherein the first part does not extend from the inner end surface of the substantially cylindrical cylinder core, the first part having a configuration which, during engagement with the extension, causes movement of the first part from its outer to its inner end position;

a second part, which is movable, relative to said inner end surface, axially between an outer end position, wherein it extends from the inner end surface of the substantially cylindrical cylinder core, and an inner end position, wherein the second part does not extend from the inner end surface of the substantially cylindrical cylinder core;

a blocking means which is movable between a blocking position, wherein the movement of the second part from said outer end position is blocked, and a non-blocking position, wherein the movement of the second part from the outer end position is permitted, and a resilient means arranged between the first and second parts of the interlocking means so that the second part follows the movement of the first part when the blocking means is in the non-blocking position.

2. The lock device according to claim 1, wherein the extension is provided with at least one flange arranged to cooperate with the interlocking means.

3. The lock device according to claim 1, wherein the first part of the interlocking means comprises a beveled end surface facing the extension.

4. The lock device according to claim 1, wherein the blocking means comprises a shoulder on an actuator and the second part comprises a pin arranged to cooperate with the shoulder on the actuator, wherein the shoulder is arranged to selectively prevent movement of the second part from its outer end position to its inner end position.

5. The lock device according to claim 4, wherein the movement of the actuator is controlled by a rotational motor.

6. The lock device according to claim 1, wherein the resilient means arranged between the first and second parts of the interlocking means comprises at least one spring.

7. The lock device according to claim 1, wherein the second part is arranged in a groove in the first part.

8. The lock device according to claim 1, comprising a circumferential groove provided in the extension near a first end portion thereof facing the substantially cylindrical cylinder core, wherein the groove and an end portion of the extension are arranged to cooperate with a recess in an end portion of the substantially cylindrical cylinder core facing the extension.

9. The lock device according to claim 1, wherein the extension comprises an adapter and a tailpiece.

10. The lock device according to claim 9, wherein the adapter has an outer diameter essentially corresponding to a diameter of a cavity in the cylinder housing and the tailpiece has a diameter larger than the diameter of the cavity.

11. A lock device comprising:

a housing;

a substantially cylindrical core with a longitudinal axis comprising an inner end surface and which is rotatably accommodated in the housing; and an extension adapted to cooperate with a lock mechanism, wherein the inner end surface faces the extension;

an interlock comprising an outer piece and an inner piece, the outer piece being coupled to the substantially cylindrical core and movable between an extended and retracted position, wherein the outer piece engages the extension in the extended position, the inner piece being coupled to the substantially cylindrical core and movable, between an extended and retracted position, wherein the inner piece engages the extension in the extended position, and wherein the inner piece does not extend beyond the inner end surface of the cylindrical core when in the retracted position;

an actuator that is movable between a first position that blocks the movement of the inner piece to the extended position and a second position that permits movement of the inner piece to the extended position; and a spring arranged between the outer and inner pieces so that the inner piece follows the movement of the outer piece when the actuator is in the second position.

12. The lock device of claim 11, wherein in the extension is provided with at least one flange arranged to cooperate with the interlock.

13. The lock device of claim 11, wherein the outer piece and the inner piece are movable axially relative to the substantially cylindrical core in a sliding relation.

14. The lock device of claim 11, wherein the outer piece has a beveled end surface facing the extension.

15. The lock device of claim 11, wherein the actuator comprises a shoulder on the actuator and the inner piece comprises a pin such that the pin is adapted to selectively engage the shoulder of the actuator, wherein the inner part is blocked from movement to the extended position when the pin engages the shoulder.

16. The lock device of claim 11 further comprising a motor, wherein the motor has a shaft that engages the actuator and operation of the motor causes the actuator to move between the first position and the second position.

17. The lock device of claim 11, wherein the outer piece comprises a groove and the inner piece resides in the groove.

18. The lock device of claim 11, wherein the extension comprises a circumferential groove about a first end portion facing the substantially cylindrical core, and wherein the circumferential groove and an end portion of the extension cooperatively engage a recess in an end portion of the substantially cylindrical core.

* * * * *